United States Patent [19]

Tamura et al.

[11] 4,393,677

[45] Jul. 19, 1983

[54] PLUGS FOR USE IN PIERCING AND ELONGATING MILLS

[75] Inventors: Manabu Tamura, Kanagawa; Yoshiki Kamemura, Tokyo; Masao Handa, Yokohama, all of Japan

[73] Assignee: Nippon Kokan Kabushiki Kaisha, Tokyo, Japan

[21] Appl. No.: 215,753

[22] Filed: Dec. 12, 1980

[30] Foreign Application Priority Data

Dec. 25, 1979 [JP] Japan ..... 54-167515

[51] Int. Cl.[3] ..... B21B 19/04

[52] U.S. Cl. ..... 72/97; 72/209

[58] Field of Search ..... 72/42, 46, 47, 97, 209, 72/476, 479, 370

[56] References Cited

U.S. PATENT DOCUMENTS 2,197,098 4/1940 Davis et al. ..... 72/476 X
3,237,441 3/1966 Eberle ..... 72/209
3,295,346 1/1967 Bomberger ..... 72/41
3,962,897 6/1976 Way et al. ..... 72/209

FOREIGN PATENT DOCUMENTS 1032271 6/1966 United Kingdom ..... 72/46

*Primary Examiner*—Ervin M. Combs
*Attorney, Agent, or Firm*—Frishauf, Holtz, Goodman & Woodward

[57] ABSTRACT

A plug for use in a piercing and elongating mill characterizing in that an adherent durable surface layer consisting essentially of iron oxides, i.e. FeO, $Fe_3O_4$, $Fe_2O_3$ or mixtures thereof is formed on the surface of the plug by spraying said molten iron oxide powder onto the plug surface to form said layer. The powder may also contain oxides of chromium, nickel, cobalt, copper, manganese and alloys thereof. The plug is preferably coated with a layer of nickel aluminum before the iron oxide powder is sprayed thereon.

15 Claims, 10 Drawing Figures

PLUGS FOR USE IN PIERCING AND ELONGATING MILLS

BACKGROUND OF THE INVENTION

This invention relates to a sprayed plug for use in a piercing and elongating mill, more particularly a plug having an excellent durability and utilized in piercing mills.

A plug is used for a piercing and elongating mill adapted to manufacture seamless steel pipes. Heretofore, such plug has been prepared by casting an alloy steel containing 0.3% by weight of carbon, 3% by weight of chromium and 1% by weight of nickel, heating the steel alloy to a temperature of 900°~950° C. and then cooling. In a Mannesmann piercing mill, a heated steel piece is rolled between opposed rolls which are inclined with respect to the axis of the plug at the same time the plug is pushed into the central portion of the steel piece to enlarge the central opening, thus obtaining a pipe having desired inner diameter. Since the plug is brought into slide contact with the steel piece heated at a temperature of about 1200° C., it suffers extensive damage such as wear, abrasion and deformation so that its durability or number of uses is low. Damaged plug forms scratches on the inner surface of the pipe so that it is necessary to exchange the plug before it becomes badly damaged. Accordingly, it is necessary to carefully and frequently inspect the plug which requires much time and labour. Where the plug is fixed to a mandrel rod, time and labour are required to exchange the damaged plug thus decreasing productivity. As an example of an improved plug having increased durability, an alloy steel containing 0.2% by weight of carbon, 1.6% by weight of chromium, 0.5% by weight of nickel, 1.25% by weight of cobalt and 1% by weight of copper has been proposed. However, this alloy is not economical because it contains copper and cobalt. Especially, cobalt is not stably available because of its poor resources. Moreover, all prior art plugs have been heat treated to form an oxide scale thereon. While the oxide scale provides heat insulation and a lubricating function between the heated steel piece and the body or core of the plug, as has been clearly pointed out in U.S. Pat. No. 3,962,897 the oxide scale can not exhibit sufficiently large heat insulation and lubrication functions where the steel piece has a tendency of entrapping the slag. To obviate this problem, there has been proposed a plug made of a cobalt base heat resisting alloy not formed with the oxide scale. The plug made of such a cobalt base steel alloy is not only expensive but also the experiment made by the inventors showed that it does not always have high durability. Although this type of plug is not formed with an oxide scale, as it is subjected to a solid solution heat treatment and an aging heat treatment its manufacturing cost is high.

FIG. 1 of the accompanying drawing shows one example of the damage of a prior art plug which is used for a Mannesmann piercing mill. Thus, wear 11 and pealing-off 12 are formed at the fore end, while wrinkles 13 or cracks 14 are formed on the body portion. The wrinkles 13 are formed due to the insufficient high temperature strength, while the cracks 14 are formed due to the thermal stress and the insufficient toughness. The wear 11 and peeling-off 12 are caused by wearing away of the surface scale thereby causing seizure. For this reason, it has been practically difficult to obtain a plug having improved durability and free from such damages caused by different causes. Consequently, a low alloy steel containing 0.3% by weight of carbon, 3% by weight of chromium and 1% by weight of nickel, for example, has been preferred. The wrinkles 13 or cracks 14 shown in FIG. 1 are caused by a rise in the surface temperature. For this reason, these defects can be eliminated if an oxide scale having a sufficiently large heat insulating property could be formed. And example of such improvement is disclosed in Japanese laid open patent application No. 17363/1979. According to the method disclosed therein the heating atmosphere utilized to form the oxide scale is controlled by admixing water therewith so as to form a stable oxide scale. With this method, however, the plug is not improved to maintain adequate balance among the shape, heat insulating property and lubricating property of the oxide scale, and the mechanical characteristics of the base metal alloy can not withstand piercing conditions which are becoming severer with year.

SUMMARY OF THE INVENTION

Accordingly, it is an object of this invention to provide a low price plug for use in a piercing mill having an excellent durability.

Another object of this invention is to provide a plug for use in a piercing mill formed with an oxide scale of the plug which has better insulating and lubricating properties than those of the prior art plug.

According to this invention, there is provided a plug for use in a piercing and elongating mill characterizing in that a layer of powder consisting essentially of iron oxides, i.e. FeO, $Fe_3O_4$, $Fe_2O_3$ or mixtures thereof is formed on the surface of the plug by spraying said powder in a molten state. The powder may also contain oxides of chromium, nickel, cobalt, copper, manganese and alloys thereof.

BRIEF DESCRIPTION OF THE DRAWINGS

Other objects and the advantages of the invention can be more fully understood from the following detailed description taken into conjunction with the accompanying drawings in which.

Each micrograph shown in FIGS. 6–10 was photographed with a magnification factors of 100.

DESCRIPTION OF THE PREFERRED EMBODIMENTS

As above described, the invention relates to a plug for use in a piercing mill in which a mixture of molten iron oxides is sprayed on the surface of the plug. However, there is no limit for the chemical composition of the alloys utilized to construct the core of the plug. However, since the plug is usually used for a Mannesmann piercing mill the plug should have greater mechanical strength than the steel piece to be pierced and a toughness sufficient for the piercing operation (for example, a Sharpy impact value of 0.1 Kg-m/cm$^2$ or more). The plug may be heat treated to adjust its mechanical characteristics. Of course, it may be a forged piece and may have ordinary surface irregularity. When the plug is formed by casting, its surface defects are removed to have a smooth surface.

Figure 1:
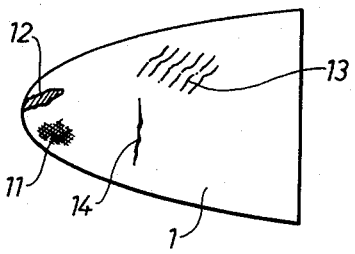
FIG. 1 is a diagrammatic representation of a prior art plug showing typical damages.
Figure 2:
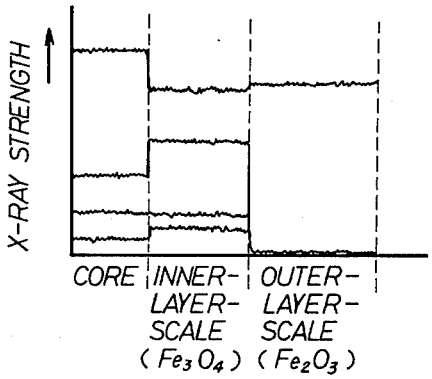
FIG. 2 is a graph showing the result of EPMA (Electron Probe Micro Analyzer) analysis of the scale before actual use of a prior art plug.
Figure 3:
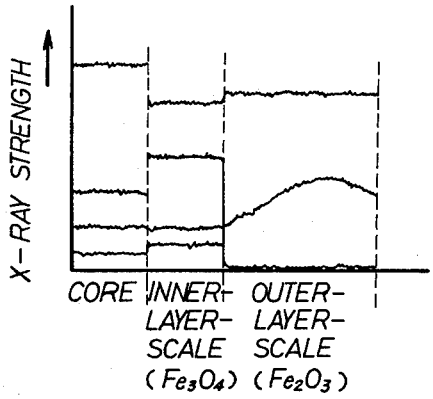
FIG. 3 is a graph showing the result of EPMA analysis of the scale during actual use of the prior art plug.
Figure 6:
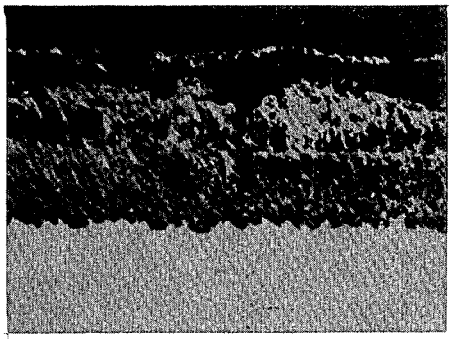
FIG. 6 is a micrograph showing the microstructure of the prior art plug before use.

FIG. 6 is a microstructure of the oxide scale of the prior art plug before use. This oxide scale has a two layered structure. The outer layer comprising $Fe_2O_3$ is easy to peel off, while the inner layer comprising $Fe_3O_4$ is tight and not easy to peel off. The result of the EPMA analysis of this oxide scale is shown in FIG. 2 showing that in the inner scale layer, in addition to iron, chromium, silicon nickel and manganese were detected.

Figure 7:
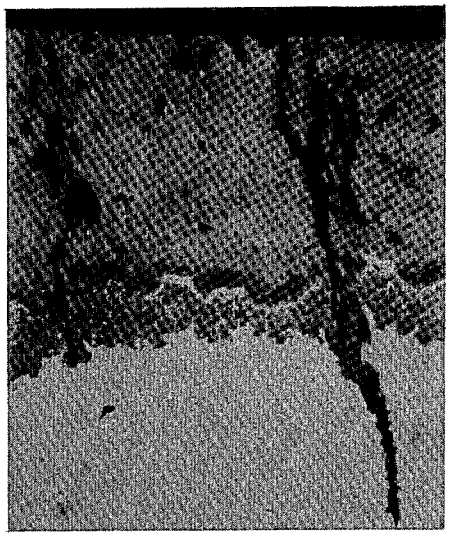
FIG. 7 is a micrograph showing the microstructure of the same prior art plug after use.
Figure 8:
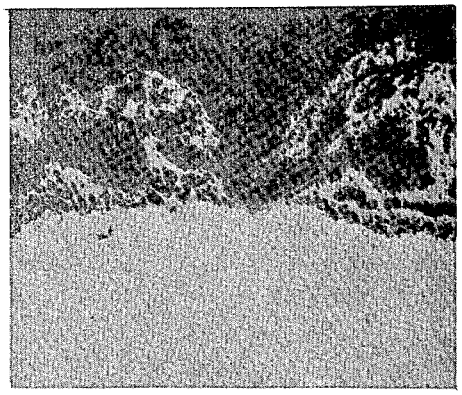
FIG. 8 is a micrograph showing the microstructure of the oxide scale formed on the surface of a prior art plug before use.
Figure 9:
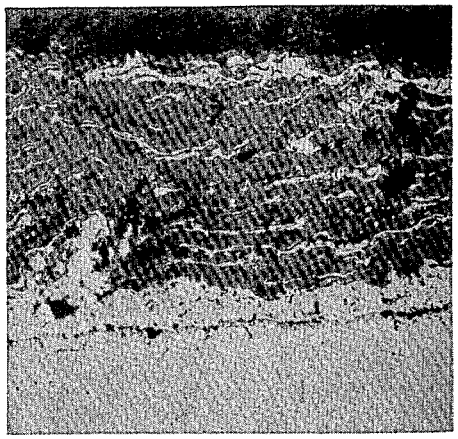
FIG. 9 is a micrograph showing the microstructure of the scale where a prime coating consisting a mixture of nickel and aluminum is applied and then a molten mixture of Fe and $Fe_3O_4$ was sprayed.
Figure 10:
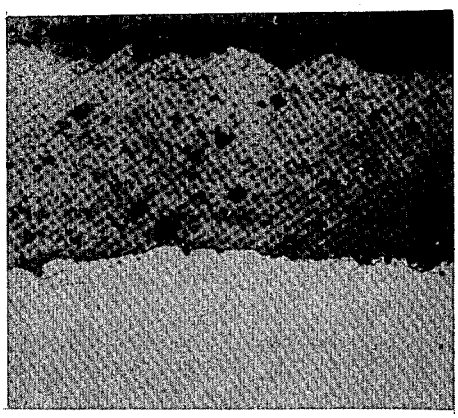
FIG. 10 is a micrograph showing the microstructure of a plug after spraying molten $Fe_3O_4$ on the surface of the plug.

On the other hand, FIG. 7 is a microstructure of the oxide scale of the prior art plug after use. This oxide scale has a two layered structure, too. But, the result of the EPMA analysis and x-ray diffraction test of the oxide scale shows that the outer layer is rich in iron and consists essentially of FeO, whereas the inner layer contains chromium and silicon in addition to iron and consists essentially of an oxide of $Fe_3O_4$ type. Presence of FeO in the outer layer and $Fe_3O_4$ in the inner layer can not be explained by thermodynamics of oxidizing phenomenon. FeO formed on the surface of the plug during use can be observed only after several passes, but it is thought that FeO is formed during the piercing operation and the FeO is then pressed against the surface of the plug.

Thus, the FeO layer provides heat insulating and lubricating actions during the operation of the piercing mill and the oxide layer of $Fe_3O_4$ which was formed prior to use is believed to prevent seizure between the plug and the steel piece to be pierced. For this reason, FeO may be formed on the surface of the plug before its actual use. When a steel piece containing a moulding powder utilized at the time of pouring molten steel into a mould to form a steel ingot for adjusting rise of the molten steel or for preventing seizure in the art of continuous casting, is subjected to piercing rolling, the plug surface becomes a glass like substance with lower durability. The glass like layer contains $SiO_2$ and CaO as its principal ingredients and these ingredients react with the oxides on the surface of the plug to decrease the viscosity of the oxides at high temperature. For this reason, such composition is not suitable to be sprayed onto the plug surface in a molten state. Moreover, such glass like substance on the plug surface adheres to the inner surface of the rolled pipe thus forming scratches thereon.

For the reason described above, the powder sprayed onto the plug surface in a molten state should satisfy the following conditions.

1. Since the heating termperature of the steel piece is about 1200° C. and the heat generated by working and friction is added thereto, the temperature of the steel pipe at the time of piercing would be increased to about 1250° C. According to this invention the material to be sprayed must have an adequate viscosity and heat insulating property at this working temperature. Moreover, the material should not have a glass like property or become glass like material. In order to satisfy these requirements, it is necessary for the material not to contain large amount of $SiO_2$, $Al_2O_3$, $B_2O_3$ and $P_2O_5$.

2. To have suitable heat insulating property, the material should not have any metal bond or ionic bond and must consist essentially of oxides.

3. To exhibit a suitable viscosity, the material should not melt under the temperature condition described above. The basic ingredient of the powder to be sprayed in a molten state is essentially oxides of iron, but since the core of the plug contains iron, chromium and nickel oxides of nickel and chromium should comprise the main composition in order to cause the sprayed oxide to adhere well to the plug.

These oxide mixture may contain small amounts of CaO, $SiO_2$, $V_2O_5$ and $P_2O_5$. However, if these oxides are contained in a large amounts, a compound having a low melting point would be formed so that it is advantageous to limit the sum of them to be 10% or less by weight. Where $Al_2O_3$, $TiO_2$ or $ZrO_2$ is mixed with FeO, the melting point of the mixture decreases slightly with the result that compounds having a melting point of 1300° C. to 1350° C. are formed so that it is advantageous to limit the sum of them to be 20% or less by weight. Since addition of oxides of Cr, La, Mg, Mn and Y to the oxides of iron, i.e. FeO, $Fe_3O_4$ and $Fe_2O_3$ has a tendency of increasing the melting point so that these elements are preferred to be used as the powder to be sprayed in a molten state. Furthermore, when added to the oxides of iron, oxides of Ni, Co, Cu, Mo and W do not lower the melting point.

When powders of iron and $Fe_3O_4$ are admixed at a stoichiometric ratio and heated in a reducing atmosphere prevailing at the time of Mannesmann piercing FeO is formed so that the powder to be sprayed in a molten state may contain a certain amount of metal. Furthermore, for the purpose of increasing adherence to the metal of the plug, the elements Fe, Cr, Ni, Co and Cu which are the same as those contained in the plug core may be added to the mixture of oxides.

In summary, the powder to be sprayed in molten state must satisfy the following conditions.

The powder should be a composition containing oxides of iron as the principal ingredient and the remainder consisting of oxides of Cu, Mg, B, Y, La, Al, Ti, Zr, Cr, Mo, W, Mn, Co and Ni and such impurities as the oxides of Ca, Si, P and V. Thus, the powder should be an oxide having a melting point higher than the maximum rolling temperature (usually about 1250° C., but differs according to the rolling system) and not have glass like characteristics, or a mixture of powders of a compound of oxides or solid solutions thereof.

Further, the powder may contain up to 50% by weight of the powders of such metals or alloys as Fe, Cr, Ni, Co and Cu which are contained in the plug. In the case of iron the following reaction takes place.

$$Fe + Fe_2O_3 \rightarrow FeO$$

Where wustite is formed by admixing Fe and hematite, the amount of Fe may be about 22% by weight based on the weight of the mixture.

Molten powder is sprayed onto the surface of the plug after coarsening the surface by shot blast. Where the molten powder does not adhere well to the plug, a prime coating consisting of nickel and aluminum is applied. The method of spraying in a molten state may be powder flame spraying, plasma spraying or detonation spraying.

Where the particle size of the powder to be sprayed in a molten state is less than one micron, the mixture absorbs moisture in air thereby decreasing the fluidity and workability, whereas where the grain size is larger than 1 mm, the surface of the coated plug is too coarse to be used satisfactorily.

When the thickness of the sprayed oxides is less than 0.05 mm, sufficient heat insulating property cannot be attained, whereas the sprayed oxides thicker than 2 mm is easy to peel off.

Table 1 shows the result of test made on various piercing plugs containing 0.3% by weight of carbon, 3% by weight of chromium, 1% by weight of nickel and the balance of iron and heat treated after casting and formed with surface coating of iron oxides or a mixture of iron and iron oxides by plasma spraying.

TABLE 1

| sample No. | pretreatment of plug | powder sprayed (% by weight) | thickness (mm) | durability (number of uses) |
|---|---|---|---|---|
| 1 | grinding and shot blasting | Fe 20% $Fe_3O_4$ 80% | 0.6 | 3 |
| 2 | grinding, shot blasting and Ni—Al | Fe 20% $Fe_3O_4$ 80% | 0.3 | 54 |
| 3 | grinding, shot blasting and Ni—Al + $Al_2O_3$ | Fe 20% $Fe_3O_4$ 80% | 0.3 | 8 |
| 4 | grinding and shot blasting | $Fe_3O_4$ 100% | 0.3 | 16 |
| 5 | grinding, shot blasting and Ni—Al | $Fe_3O_4$ 100% | 0.3 | 24 |
| 6 | same as sample 3 | $Fe_3O_4$ 100% | 0.3 | 4 |
| 7 | same as sample 2 | FeO 90% $Fe_3O_4$ 10% | 0.3 | 35 |
| 8 | same as sample 2 | $Fe_3O_4$ 50% $Fe_2O_3$ 50% | 0.3 | 20 |
| 9 | after heat treatment scale was formed | Fe 20% $Fe_3O_4$ 80% | 0.3 | 2 |
| 10 | same as sample 9 | Fe 20% $Fe_3O_4$ 80% | 0.3 | 2 |
| 11 | same as sample 9 | — — | (0.1) | 2 |

Remarks
1. The plugs tested were ordinary piercing plugs containing 0.3% by weight of carbon, 3% by weight of chromium, 1% by weight of nickel and the balance of iron and heat treated at 935° C. for 5 hours.
2. Ni—Al is a powder of self-bonding type and sprayed in a molten state.
3. Sample 11 is an ordinary plug.

More particularly, samples 1 through 6 show the result of a piercing test made on a plug subjected to shot blasting after grinding, a plug, after grinding and blasting shot a mixture of powders of Ni and Al was sprayed in a molten state, and a plug on which a powder of $Al_2O_3$ was further sprayed in a molten state which were prepared by taking into consideration the fact that the peel off characteristic of the coated film applied by molten spray is influenced by the pretreatment of the surface of the plug. To form a final coating, a powder of $Fe_3O_4$ or a mixture of powders of iron and $Fe_3O_4$ was sprayed in a molten state on the surface of the plug pretreated in a manner just described.

Comparison of samples 2 and 5 with the control sample 11 shows that their durability is 54 and 24 respectively which is much larger than that of sample 11.

The durability of samples 1 and 4 is 3 and 16 whereas that of samples 3 and 6 is 8 and 4 meaning that the durability of these samples is a little better than that of the prior art plug but not sufficiently large for practical use. The durability of samples 7 and 8 is b 35 and 20 respectively which are much larger than that of the prior art plug. On the other hand the durability of samples 9 and 10 is the same as that of the prior art plug showing no improvement. This may be attributable to the fact that the oxide scale formed by heat treatment has a double layer construction, the lower layer consisting essentially of $Fe_3O_4$ having excellent peeling-off resistant property, while the upper layer consisting essentially of $Fe_2O_3$ which peels off readily. For this reason, even when a thick coating is sprayed in a molten state onto the upper layer, the resulting coating readily peel off.

Table 2 below shows the result of rolling test in which elongator plugs were precoated with a mixture of Ni and Al which showed good result as shown in Table 1, and then a coating of $Fe_3O_4$ or a mixture of powders of iron and $Fe_3O_4$ was formed on the Ni-Al mixture by spraying.

TABLE 2

| sample No. | pretreating of the plug | powder sprayed (% by weight) | thickness (mm) | durability (number of uses) |
|---|---|---|---|---|
| 1 | grinding, shot blasting and Ni—Al | Fe 20% $Fe_3O_4$ 80% | 0.6 | 350 |
| 2 | grinding, shot blasting and Ni—Al | $Fe_3O_4$ 100% | 0.6 | 250 |
| 3 | — | — | (0.6) | 200 |

Remarks
1. The plugs were elongator plugs containing 0.3% by weight of carbon, 3% by weight of chromium, 1% by weight of nickel, 5% by weight of molybdenum and the balance of iron and subjected to a heat treatment at a temperature of 935° C. for 5 hours.
2. Sample No. 3 is an ordinary plug.

Samples 1 and 2 subjected to a specific pretreatment show considerable improvement of the durability over the control sample 3.

The following Table 3 shows the result of piercing test made on the effect of the composition of the powders sprayed in a molten state, and a stainless steel plug, sprayed with molten powders of iron and $Fe_3O_4$. Such a stainless steel plug has been considered to be unsuitable because of seizure damage caused by the fact that excellent oxide scale could not be formed with an ordinary heat treatment.

TABLE 3

| sample No. | composition of the plug | sprayed powder (% by weight) | | thickness (mm) | durability (number of uses) |
|---|---|---|---|---|---|
| 1 | 0.3C—3Cr—1Ni | $Fe_3O_4$ 75% | $Cr_2O_3$ 25% | 0.6 | 29 |
| 2 | 0.3C—3Cr—1Ni | $Fe_3O_4$ 75% | NiO 25% | 0.6 | 41 |
| 3 | 0.3C—3Cr—1Ni | $Fe_3O_4$ 75% | CoO 25% | 0.6 | 38 |
| 4 | 0.3C—3Cr—1Ni | $Fe_3O_4$ 75% | $Cu_2O$ 25% | 0.6 | 21 |

TABLE 3-continued

| sample No. | composition of the plug | sprayed powder (% by weight) | | thickness (mm) | durability (number of uses) |
|---|---|---|---|---|---|
| 5 | 0.3C—3Cr—1Ni | $Fe_3O_4$ 75% | $Mn_3O_4$ 25% | 0.6 | 38 |
| 6 | 0.3C—3Cr—1Ni | $Fe_3O_4$ 75% | $SiO_2$ 25% | 0.6 | 2 |
| 7 | 0.3C—3Cr—1Ni | $Fe_3O_4$ 80% | Cr 20% | 0.6 | 33 |
| 8 | 0.3C—3Cr—1Ni | $Fe_3O_4$ 80% | Ni 20% | 0.6 | 48 |
| 9 | 0.3C—3Cr—1Ni | $Fe_3O_4$ 80% | Co 20% | 0.6 | 29 |
| 10 | 0.3C—3Cr—1Ni | $Fe_3O_4$ 80% | Cu 20% | 0.6 | 41 |
| 11 | 0.3C—3Cr—1Ni | $Fe_3O_4$ 80% | Mn 20% | 0.6 | 32 |
| 12 | 0.3C—3Cr—1Ni | $Fe_3O_4$ 60% | Fe 20% $Cr_2O_3$ 20% | 0.6 | 40 |
| 13 | 18Cr—12Ni—2Mo—Fe | $Fe_3O_4$ 80% | Fe 20% | 0.6 | 83 |

Remarks
1. Samples other than 13 are ordinary piercing plugs containing 0.3% by weight of carbon, 3% by weight of chromium, 1% by weight of nickel and the balance of iron and subjected to a F.C heat treatment at a temperature of 935° C. for 5 hours, whereas sample 13 is a plug as cast austenite stainless steel having a composition just described.
2. The pretreatment comprises grinding, shot blasting and spraying a mixture of Ni and Al.

Samples 1 through 5 are plugs sprayed with a mixture of powders of $Fe_3O_4$ and oxides of Cr, Ni, Co, Cu and Mn, respectively. These samples have a high durability of 21–41 which is much higher than that of the prior art plug. However, sample No. 6 has only 2 durability showing no improvement, because when $SiO_2$ is admixed with $Fe_3O_4$ the melting point is lowered so that the coating becomes glass like when subjected to a high piercing temperature (about 1200° to 1250° C.).

Figure 4:
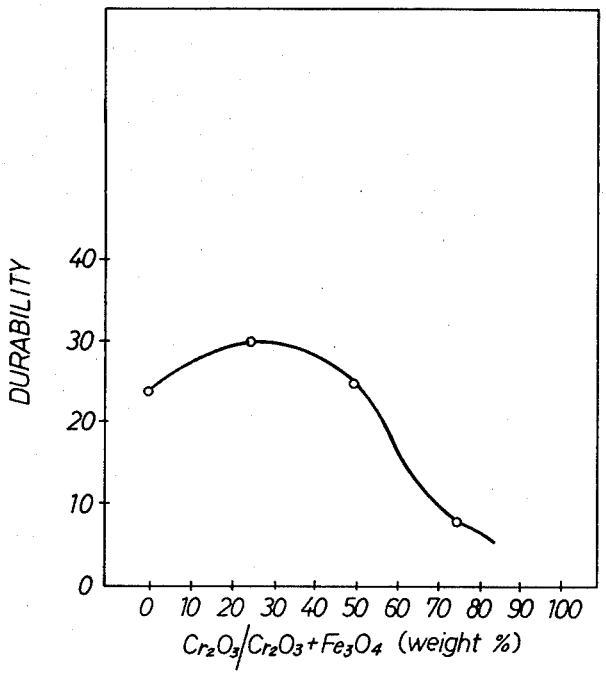
FIG. 4 is a graph showing the effect of $Cr_2O_3$ in a mixture of powders of $Cr_2O_3$ and $Fe_3O_4$ upon a piercing plug containing 0.3% by weight of carbon, 3% by weight of chromium, 1% by weight of nickel and the balance of iron and impurities when the molten mixture of $Cr_2O_3$ and $Fe_3O_4$ is sprayed upon the plug.

FIG. 4 shows the result of piercing test of plugs molten sprayed with powders containing $Fe_3O_4$ and $Cr_2O_3$ at various ratios. As can be noted from FIG. 4, the mixture containing up to 50% by weight of $Cr_2O_3$ shows somewhat better durability than a case consisting of only $Fe_3O_4$, but when the weight percentage of $Cr_2O_3$ reaches 75% the durability decreases below that of a case consisting of only $Fe_3O_4$.

Samples 7–11 shown in Table 3 show plugs molten sprayed with a mixture of powders of $Fe_3O_4$, and Cr, Ni, Co, Cu and Mn respectively. The durability of these plugs are 29~48 which are much greater than that of the prior art plug.

Comparison of these results with those of samples No. 2 (a mixture of $Fe+Fe_3O_4$) and No. 5 ($Fe_3O_4$) shown in Table 1 shows that mixtures of $Fe_3O_4$ and metal powders have higher durability than a powder consisting of only $Fe_3O_4$. This is caused by the fact that where a certain amount of metal powder is incorporated, ductile metal powder functions as a bonding agent as shown in the micrograph shown in FIG. 9 thus improving peeling-off resistant property of the sprayed coating.

Figure 5:
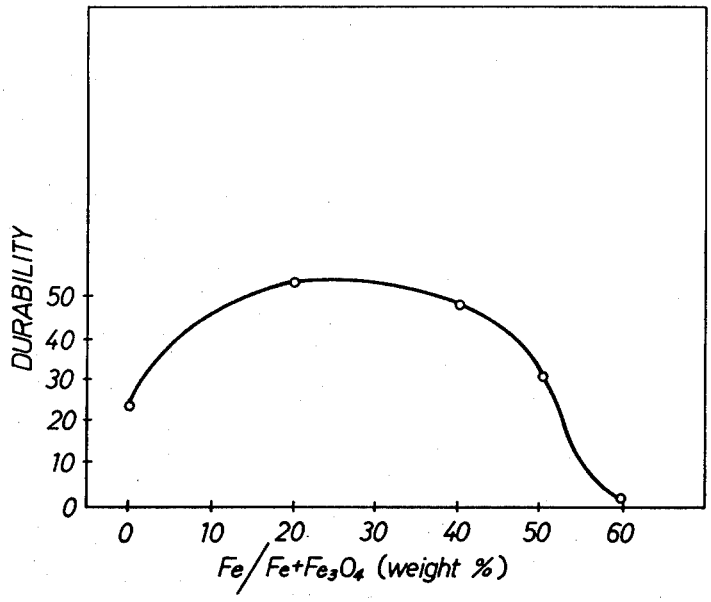
FIG. 5 is a graph showing the effect of the amount of iron in a powder mixture of iron and $Fe_3O_4$ when the molten mixture is sprayed upon a plug having the same composition as the plug shown in FIG. 4.

However, as the oxide scale formed by molten spray onto the surface of the plug is provided for the purpose of imparting heat insulating and lubricating properties, mixture of a large quantity of metals into the powder to by sprayed in a molten state is not suitable. More particularly, the results of experiments made for mixtures containing varying amounts of metal powders are shown in FIG. 5 which shows that the percentage of the metal powders lies in a range of 0–50% by weight, the durability is higher than that of the prior art heat treated plug but as the percentage of the metal powders reaches 60% the durability decreases greatly. Thus, such plug causes seizure problem only after twice piercing operations.

Sample No. 12 shown in Table 3 utilizes a mixture of $Fe_3O_4$, $Cr_2O_3$ and Fe and shows an excellent durability. Sample No. 13 comprises a core made of austenite stainless steel which has been unsuitable to use as the core metal because it is impossible to form satisfactory oxide scale by heat treatment but the plug was coated with molten mixture of Fe and $Fe_3O_4$. This plug had a durability of 83 which is much higher than the durability 54 of a plug obtained by spraying the same mixture upon a core of a low alloy steel having a composition of 0.3% by weight of carbon, 3% by weight of chromium and 1% by weight of nickel and the balance of iron.

While the invention has been described in terms of some specific embodiments, it will be clear that many changes and descriptions may be made without departing from the scope of the invention as defined in the appended claims.

What we claim:

1. A plug for use in a piercing and elongating mill to manufacture seamless steel pipes having its surface coated with a highly adherent durable heat insulating layer consisting essentially of iron oxides comprising at least one oxide selected from the group consisting of FeO, $Fe_3O_4$, and $Fe_2O_3$ which had been formed on the surface of said plug by spraying molten powder consisting essentially of iron oxide onto the surface of the plug to form said layer, said iron oxide molten powder which is sprayed onto the surface of said plug also contains at least one metal or oxide selected from the group consisting of the oxides of chromium, nickel, copper and manganese, and the metals iron, chromium, nickel, cobalt, copper and manganese.

2. The plug of claim 1, wherein said insulating layer consisting essentially of iron oxides contains said iron oxides in an amount greater than 50% by weight of said insulating layer.

3. The plug of claim 3, wherein said insulating layer has a thickness of between 0.05 and 2 mm.

4. The plug of claim 3, wherein said molten powder consisting essentially of iron oxide which is sprayed onto the surface of said plug contains chromium or chromium oxide.

5. The plug of claim 3, wherein said molten powder consisting essentially of iron oxide which is sprayed onto the surface of said plug contains iron in an amount of at least 10% by weight of said powder.

6. The plug of claim 3, wherein said molten powder consisting essentially of iron oxide which is sprayed onto the surface of said plug contains at least one oxide selected from the group consisting of the oxides of chromium, nickel, copper and manganese.

7. The plug of claim 3, wherein said molten powder consisting essentially of iron oxide which is sprayed onto the surface of said plug contains at least one metal selected from the group consisting of iron, chromium, nickel, cobalt, copper and manganese.

8. The plug of claim 1, wherein said plug comprises a carbon steel or an austenitic stainless steel.

9. The plug of claim 3, wherein said plug consists essentially of an austenitic stainless steel.

10. The plug of claim 1, wherein said plug consists essentially of an 18 chromium 8 nickel stainless steel.

11. A plug for use in a piercing and elongating mill to manufacture seamless steel pipes having its surface coated with a highly adherent durable heat insulating layer consisting essentially of iron oxides comprising at least one oxide selected from the group consisting of FeO, $Fe_3O_4$, and $Fe_2O_3$ which had been formed on the surface of said plug by spraying a molten mixture of nickel and aluminum powders on the surface of said plug and then by spraying molten powder consisting essentially of iron oxide onto said layer formed by said spraying of nickel and aluminum to form said heat insulating layer with said layer formed by said spraying of nickel and aluminum being between the surface of the plug and said insulating layer and being integral with said surface of the plug and said insulating layer.

12. The plug of claim 11, wherein said insulating layer consisting essentially of iron oxides contains said iron oxides in an amount greater than 50% by weight of said insulating layer.

13. The plug of claim 11 or 12, wherein said insulating layer has a thickness of between 0.5 and 2 mm.

14. The plug of claim 11 or 12, wherein said plug comprises a carbon steel or an austenitic stainless steel.

15. The plug of claim 1 or 11, wherein said molten powder which is sprayed is formed from powder having a grain size of between 1$\mu$ and 1 mm.

* * * * *

UNITED STATES PATENT AND TRADEMARK OFFICE

CERTIFICATE OF CORRECTION

PATENT NO. : 4,393,677

DATED : July 19, 1983

INVENTOR(S) : Manabu TAMURA et al

It is certified that error appears in the above-identified patent and that said Letters Patent is hereby corrected as shown below:

Column 2, line 31: replace "characterizing" with --characterized--.

Column 5, lines 63-64: replace "blasting shot" with --shot blasting--.

Column 6, line 13: before "35" delete "b".

Column 8, line 41 (Claim 3): replace "3" with --1 or 2--.

Signed and Sealed this

*Twentieth* Day of *March 1984*

[SEAL]

*Attest:*

GERALD J. MOSSINGHOFF

*Attesting Officer*

*Commissioner of Patents and Trademarks*